US005515655A

United States Patent [19]

Hoffmann

[11] Patent Number: 5,515,655

[45] Date of Patent: May 14, 1996

[54] ADJUSTABLE, TELESCOPING STRUCTURAL SUPPORT SYSTEM

[75] Inventor: Christopher J. Hoffmann, Birmingham, Mich.

[73] Assignee: Sloan Enterprises, Inc., Birmingham, Mich.

[21] Appl. No.: 303,086

[22] Filed: Sep. 8, 1994

[51] Int. Cl.[6] ..... E04B 9/00

[52] U.S. Cl. ..... 52/126.6; 52/157; 52/263; 52/DIG. 11; 403/379; 248/354.5

[58] Field of Search ..... 52/157, 126.6, 52/263, DIG. 11; 403/109, 377, 378, 379; 248/354.4, 354.5, 188.5

[56] References Cited

U.S. PATENT DOCUMENTS

| | | | |
|---|---|---|---|
| 2,685,353 | 8/1954 | Corkie | 248/354.5 X |
| 3,067,846 | 12/1962 | Luebkemon | 52/157 |
| 3,158,003 | 11/1964 | Dolly | 52/263 |
| 4,125,975 | 11/1978 | Soble | 52/126 |
| 4,546,581 | 10/1985 | Gustafson | 52/126.6 X |

FOREIGN PATENT DOCUMENTS

| | | | |
|---|---|---|---|
| 2418319 | 10/1979 | France | 52/126.6 |

*Primary Examiner*—Carl D. Friedman
*Assistant Examiner*—W. Glenn Edwards
*Attorney, Agent, or Firm*—Basile and Hanlon

[57] ABSTRACT

A pier foundation system provides for a preformed building structure to be erected on site in a final position level to ground. The system includes first and second elongated cylindrical members telescopically engaged with one another defining a longitudinally extendable load bearing member with first and second ends. The second cylindrical member is installable extending below ground level. The first member includes a plurality of longitudinally spaced first apertures extending through diametrically opposed side walls. The second member includes a plurality of longitudinally spaced and equally angularly spaced second apertures extending through diametrically opposed side walls. The first and second cylindrical members are movable longitudinally and rotatably relative to one another to bring one of the first apertures into coaxial alignment with one of the second apertures. A fastener member is engageable through the aligned first and second apertures for locking the first and second members in a fixed position relative to one another at a selected position of telescopic extension to level the structure with respect to the ground in a final position.

25 Claims, 4 Drawing Sheets

ADJUSTABLE, TELESCOPING STRUCTURAL SUPPORT SYSTEM

FIELD OF THE INVENTION

The present invention relates to an adjustable, telescoping structural support system, such as a steel pier foundation system for manufactured housing having vertical loading bearing capacity and resistance to uplift and side loads.

BACKGROUND OF THE INVENTION

Various types of anchoring and support systems have been proposed that include adjustable features. In particular with respect to supporting manufactured housing, or modular housing, structural units or other preformed or preshaped modular building components, a wide variety of load bearing sustainer or shaft configurations have been proposed to define anchoring systems and tie downs to connect the manufactured housing, or modular housing, unit or modular preformed structural component to the ground. As used in this respect, a load bearing component is defined as being sufficiently strong and rigid to act as the primary support for other construction or components against gravity or to resist transverse loading. A preform or preshape is defined as a component of a building construction which is in completed form before its use at the job site. A shaft is defined as a member which has a limited closed periphery and which is greatly elongated relative to its length. A sustainer is defined as a rigid member or construction having a limited closed periphery which is greatly elongated relative to any lateral dimension, resists transverse loading and supports or retains other components of a building construction. An anchoring system is defined to mean a combination of ties, anchoring equipment, and ground anchors, that will, when properly installed, resist movement caused by wind forces on an emplaced manufactured housing, or modular housing, or other preformed module structure. Anchoring equipment is defined as straps, cables, turnbuckles, chains, including tension, or other securing devices which are used with ties to secure a manufactured housing, or modular housing, to ground anchors. Ground anchors are defined to mean any device designed to transfer the manufactured housing, or modular housing, anchoring loads to the ground. A foundation is defined to mean the base on which a manufactured housing, or modular housing, rests. A tie is defined as straps, cables, or other securing device used to connect a manufactured housing, or modular housing, to the ground anchors.

U.S. Pat. No. 4,684,097 discloses a mobile home stanchion for supporting a mobile home. The stanchion includes a base, an intermediate vertical support fixedly secured to the base, and an upper mobile home support adjustably mounted at the upper end of the vertical support with means thereon for connection to an underside of the mobile home. This configuration has the disadvantage of requiring a concrete pad or platform to be poured at the site with anchor bolts for connection to the stanchion. This increases the cost of site preparation to receive the mobile home structure and increases the amount of time required between beginning site preparation and completion of the installation.

U.S. Pat. No. 4,930,270 discloses a building system having flooring supported by adjustable posts and individual beams extending between the posts which may be temporarily supported in excavations to enable the floor to be erected, and then adjusted for level. The excavations are subsequently filled with concrete to form footings. The post may extend upwardly beyond the floor beams to form wall supports. This foundation system also increases the amount of time required for site preparation and the cost involved in preparing the site. In addition, this system is only capable of course adjustment between the upper and lower parts of each post. The course adjustment is performed by pining through the appropriate mating apertures so that the floor is supported substantially at the required level.

U.S. Pat. No. 4,125,975 discloses a foundation arrangement for manufactured housing, such as mobile homes, which provides adequate support to resist overturning wind forces, as well as to prevent vertical or lateral shifting of the mobile home, due to earth movements resulting from mud or freeze-thaw induced shifting of the supporting soil. The foundation arrangement includes a plurality of telescoping stanchions which are adapted to be raised in order to be connected to the underframe and lowered to a final position. In this configuration, a series of through holes are drilled through the stanchion to accommodate a nut and bolt assembly which will act in engagement with the upper edge of the casing pipe to provide a positive downstop upon lowering of the mobile home. Resistance to uplift is provided by the weight of the mobile home, and also by wedging action between the stanchions and the casings caused by lateral wind thrust loads. The casings may also be positioned above the level of the slab or grade and provided with through holes to provide a positive lock. This configuration also requires elaborate site preparation work, consequently increasing the cost and lead time required prior to completion of the installation of the structure on site. In addition, this adjusting mechanism provides only course adjustment, typically requiring the addition of shims, such as a wooden wedge that when driven tightly together in opposing pairs between the cap and the mobile home frame acts as a stabilizing device to take up any space or gap existing between the top of the pillar or cap and the mobile home frame.

SUMMARY OF THE INVENTION

It is desirable in the present invention to provide an adjustable, telescoping structural support system that is capable of reducing installation cost and time. It is further desirable in the present invention to enhance the vertical adjustability of a manufactured housing, or modular housing, support stanchion or sustainer. The provision of horizontal adjustment of connections between the cap plate or top of the pillar and the lower structural element of the preformed modular structure is also desirable. The present invention provides a foundation arrangement for preformed structural units, such as manufactured housing, or modular housing, to support the structure at a desired elevation with respect to grade so as to resist any lateral movements of the foundation resulting from movements of the earth at the surface and also to adequately resist overturning forces produced by wind gusts.

According to the present invention, a pier foundation system is provided for supporting at least one structure to be erected on site at a final position relative to ground. The system includes an elongated, vertical load bearing member or sustainer having a first end and a second end, means for connecting the first end to the structure, means for engaging the second end in the ground and position adjusting means for holding the structure in the final position relative to ground after in situ assembly. Each vertical, load bearing member includes a lower tube or pier defined by a steel casing, such as a 4 inch outer diameter tube with a ¼ inch wall thickness. The lower tubes preferably include caps enclosing the bottom of the lower tube. Various potential designs and geometries of the lower tube can be provided for different soil conditions. The tubes are driven into the soil at predefined locations using, for example, a conventional drop hammer. The tube is typically driven forty-four inches into the ground leaving approximately six inches at the top above the surface of the ground accessible to the installer. The tube is resistant to frost heaving, since there are no horizonal surfaces above the frost line against which frost forces can work. The soil has a frictional gripping force on the entire sub-ground level surface area of the tube, including the side walls as well as the bottom.

At the top portion of the tube, there is a unique leveling system including a plurality of apertures, such as eight sets of apertures arranged in a circumferential radial pattern that interacts with apertures extending through the upper tube. These radially located apertures are spaced at equal angular intervals with respect to the longitudinal axis of the lower tube, such as 45°, and are arranged in a descending order at ⅛ inch increments from the end of the lower tube disposed above ground level. This forms a stair-step pattern or helical row of apertures that allows ⅛ inch vertical adjustment of the upper tube and thus of the structure being supported. The upper row of eight apertures is separated from the lower row by 2½ inches allowing greater structural integrity around the apertures.

Each vertical, load bearing member also includes an upper tube or pier defined by telescoping steel casings, such as a 3½ inch outside diameter tube with ¼ inch wall thickness capable of being slipped inside each lower tube allowing vertical adjustment along the coaxial longitudinal axes of the upper and lower tubes and rotational adjustment of the upper tube with respect to the lower tube prior to bolting into position at the desired height or level with ⅛ inch accuracy. The upper tube has two columns of apertures, each column extending linearly and separated by one inch spacing along the longitudinal axis. The two columns of apertures are located 180° opposite from each other and radially aligned on a common axis perpendicular to the longitudinal axis of the tube allowing a bolt or pin to pass through a selected pair of apertures in the tube. The apertures in the upper tube allow course vertical adjustment of the pier system. Fine adjustment is accomplished by matching the apertures extending through the upper tube with one set of the apertures extending through the lower tube located in one of the two ascending rows of eight apertures at the top section of the lower tube. A support bolt or pin is inserted through the upper and lower tube apertures after being aligned with one another to lock the upper and lower tubes in the respective positions and at the desired height.

The top of the upper tube has an outward extending flange providing a ¼ inch lip. This lip forms a slip joint with the top plate or cap. This joint allows the upper tubes to be rotated to attain fine vertical adjustment while the top plates stays in a stationary or fixed relationship to the supported structure. With apertures spaced in increments of one inch in the upper tube and at ⅛ inch increments in the lower tubes, it is possible to telescope and adjust the pier system anywhere in a range of multiple inches at ⅛ inch increments by simply rotating the upper tubes in relation to the lower tubes. The means for connecting the first end of the vertical member to the structure includes a top plate, such as a steel plate of approximately ¼ inch thickness. A 3¼ inch diameter aperture is formed in the center of the plate allowing the upper tube to pass through the plate, while preventing the plate from passing over the outwardly extending flange. Sufficient clearance is provided by the central aperture in the plate to allow the tube to rotate for height adjustment as previously described. The plate also has a plurality of slots, such as four slots that allow bolts for corresponding flat clamps to pass through. The slots allow flexibility for lateral adjustment of the pier system perpendicular to the longitudinal axis of the supporting beams for the structure. This lateral adjustment accounts for and is intended to overcome any mismatch created by inaccurate installation of the piers or slight discrepancy in placement of the support beams attached to the structure.

Four flat clamps are preferably used with each assembly and can be formed from steel plate approximately ¼ inch thick. Each flat clamp has a through aperture for a bolt as well as a heel section. The flat clamps can be used to affix the flange of a support beam to the top plate or cap with the outwardly extending flange on the upper tube disposed interposed between the top plate and the flange of the support beam. When the through bolts are tightened, the top plate is trapped under the flange of the upper tube causing the flange of the upper tube to be sandwiched between the flange of the support beam and the top plate. This interposition of the outer extending flange provides the required tie down feature by locking the support beam of the structure to the rest of the pier assembly which is installed in the ground. It also prevents the support system from further rotating, particularly when used with a helical blade configuration on the lower tube.

The present support system seeks to reduce installation time and related labor expenses, to extend the installation season, to provide "just-in-time" site preparation for developers, to integrally enhance the structures stability, reliability and durability, and to reduce wear on pre-graded sites. Each of these desirable characteristics will create significant cost and quality advantages over the other foundation systems presently used. The vast majority of premanufactured homes installed in rental communities have a foundation system that includes concrete piers or footings poured into excavated holes in the ground. Concrete blocks, steel stands, or jacks are stacked on top of the concrete piers, and wooden shims are used for leveling. Finally, cable tie-downs are used to anchor the home against high winds. This foundation method is obsolete and unduly labor-intensive.

The present invention provides the additional benefit that earth balancing and final grading can be completed well in advance of home emplacement. No excavated soil is created by the present invention, thereby avoiding additional earth hauling. The entire property can be seeded and mulched to provide soil erosion protection, allowing the homes to be emplaced at any time without regrading. There is no raised perimeter created by sod laid around the skirt of newly installed homes. This also reduces the health hazard of standing water and the structural hazard of chronically muddy conditions beneath installed homes. The location and number of pier supports can be customized to fit the actual footprint of each home when it is selected for the site. There is no need for the developer to incur unnecessary cash outlays before there is a designated user of each specified site. The present foundation system invention allows installation on a just-in-time basis. The steel piers can be taken out of the ground and reused if desired. The total installation process is estimated to be less than five man hours instead of a minimum of nine man hours for a conventional installation. The piers can be installed year round at no premium versus the conventional system which requires additional labor intensive procedures in frost conditions. A conventional drop hammer, or conventional jack hammer, used in combination with the present invention can penetrate frost conditions with ease. In other ground conditions, the present invention may be installed with a conventional vibratory compactor, or either of the two previously mentioned hammers. Since no cement is used, large cement trucks are not required at the site, thereby reducing damage to roads and property. In addition, work crews are not required to wait for concrete to harden. Home leveling requires only that the piers be telescoped, bolted at a specified height, and locked to the support beams on the underside of the home to be installed. This procedure reduces worktime beneath the home, thereby increasing worker safety.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED AND ALTERNATIVE EMBODIMENTS

Figure 1:
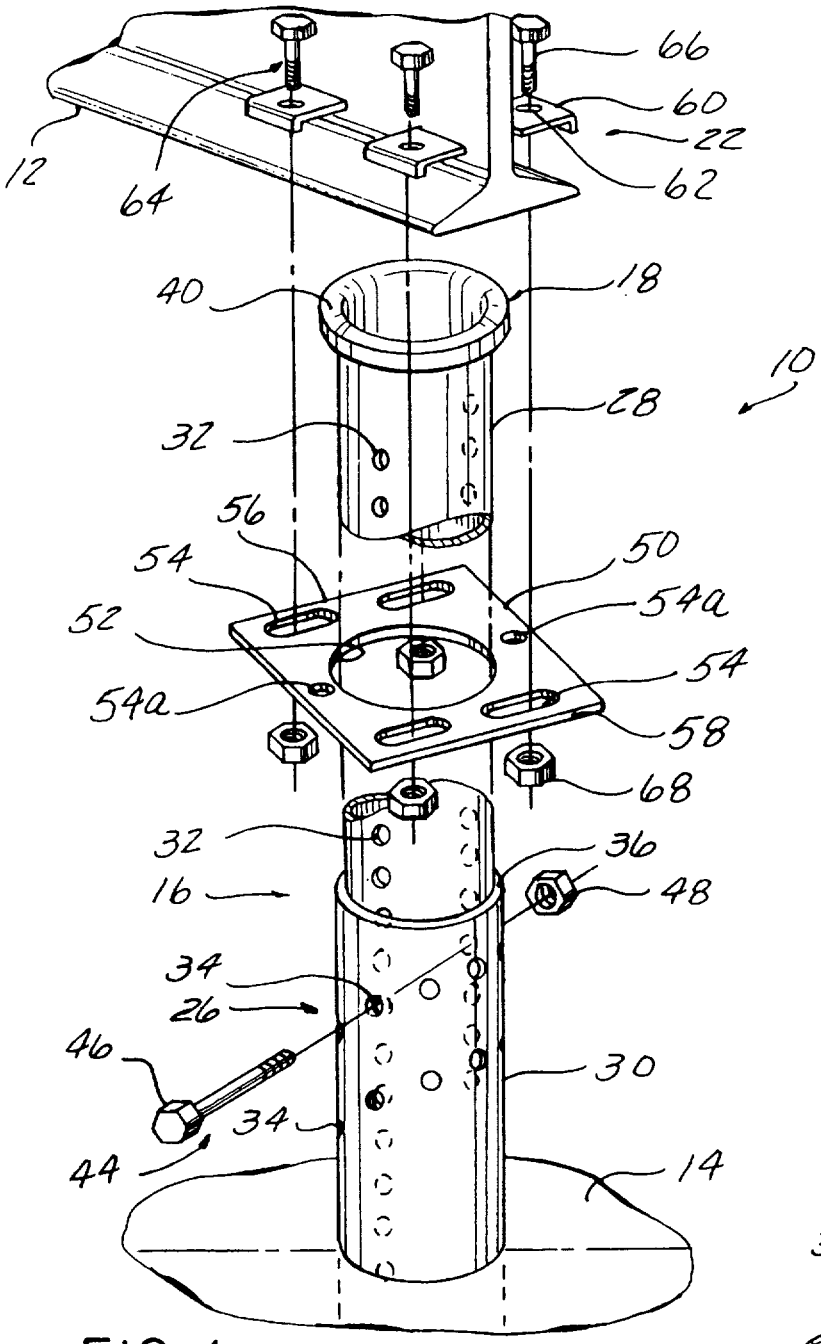
FIG. 1 is an exploded perspective view of an adjustable, telescoping structural support system according to the present invention.

An adjustable, telescoping structural support system 10 according to the present invention is illustrated in an exploded perspective view in FIG. 1. The structural support system 10 preferably is in the form of a pier foundation system for supporting at least one structure 12 to be erected on site at a final position level relative to ground 14. The pier foundation system 10 preferably includes an elongated, vertically extendable, load bearing member 16 having a first end 18 and a second end 20. Means 22 is provided for connecting the first end 18 to the structure 12 to be erected on site. Means 24 is provided for engaging the second end 20 in the ground 14. Position adjusting means 26 is provided for holding the structure 12 in a final position relative to ground 14 after in situ assembly.

The load bearing member 16 is preferably formed as first and second telescopically engaged members or sections, 28 and 30 respectively, that slide longitudinally one inside another. The first member 28 defines the first end 18 of the load bearing member 16 and the second member 30 defines the second end 20 of the load bearing member 16. The first member 28 has a plurality of longitudinally spaced first apertures 32 disposed at predetermined intervals from one another. The second member 30 has a plurality of longitudinally spaced and circumferentially spaced second apertures 34 disposed at predetermined longitudinal and angular dimensions from one another. Preferably, the longitudinal and circumferential spacing or dimensions from one another, lay out the second apertures 34 in a helically spaced pattern. In the most preferred form of the present invention, a plurality of helically spaced second apertures 34 are provided spaced longitudinally from one another. Preferably, the first and second members, 28 and 30 respectively, are formed as elongated cylindrical members or tubes with the first and second apertures 32 and 34 extending diametrically through each opposing side wall of the respective first and second member, 28 and 30 respectively. This preferred configuration creates the plurality of helically spaced second apertures best seen in the roll out detail of FIG. 4. For purposes of clarity, the second apertures 34 in this view are given the designations 34*a* through 34*h* to identify corresponding diametrically opposed apertures to facilitate further description of the present invention.

Figure 4:
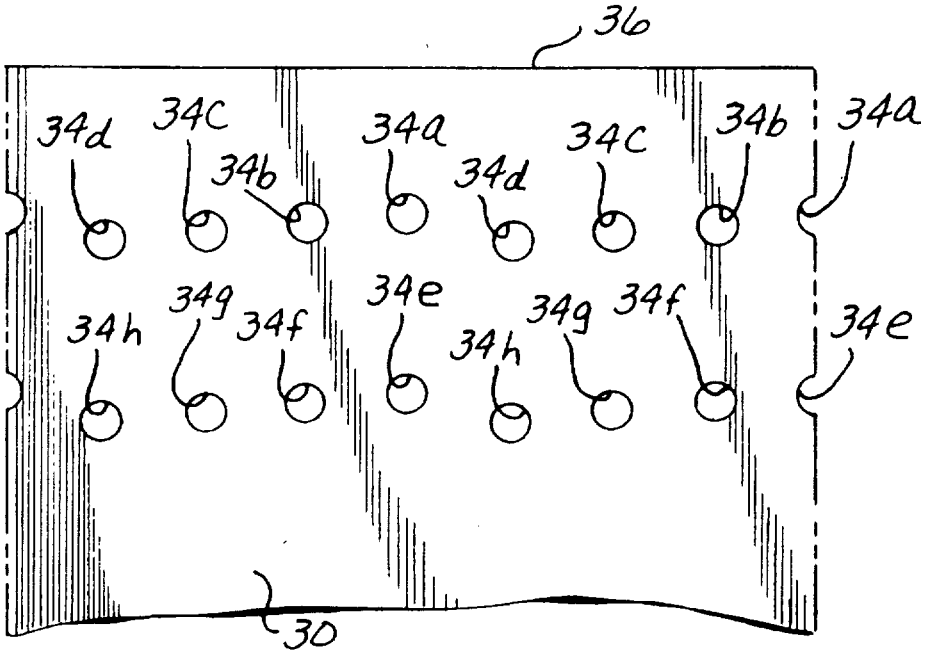
FIG. 4 is a roll out view showing the longitudinally spaced and angularly spaced apertures through an external tubular member forming part of the vertical load bearing member.

For purposes of illustration, and not by way of limitation, a specific example of the first and second members, 28 and 30, and the preferred layout of the first apertures and the second apertures 32 and 34 respectively will be given. It is anticipated that the present invention can be used as a sustainer for modular housing, or manufactured housing, with the second member 30 having an outer diameter in the range of 3½ inches to 4½ inches, with a preferred outer diameter of 4 inches. Assuming approximately ¼ inch wall thickness, the first member 28 would be sized appropriately with an outer diameter in the range of 3 inches to 4 inches to enable a slidable and rotatable telescopic connection between the first and second members, 28 and 30 respectively. For illustration purposes, the second member 30 can be formed of a four inch inside diameter schedule 40 pipe, preferably galvanized. The second member 30 defines the second end 20 of the load bearing member 16 which is engageable in the ground. The opposite end 36 of the second member 30 is disposed above ground. Referring to FIG. 4, the first set of diametrically opposed second apertures 34*a* can be formed spaced longitudinally from the end 36 of the second member 30 by a distance of 2.000 inches. The second set of diametrically opposed second apertures 34*b* would be spaced a dimension of 2.125 inches from the end 36. The third set of diametrically opposed second apertures 34*c* could be formed at a dimension of 2.250 inches from the end 36, while the fourth set of diametrically opposed apertures 34*d* is spaced longitudinally from the end 36 by a 2.375 inch dimension. When viewed from above, the second member 30 is preferably circular in cross-section and each of the apertures is disposed equally, angularly spaced from one another, such as by 45°. The second tier of helically spaced second apertures 34 as shown in FIG. 4 are designated 34*e*, 34*f*, 34*g* and 34*h*, and are spaced longitudinally from the end 36 by 4.500 inches, 4.625 inches, 4.750 inches and 4.875 inches respectively. The first and second apertures are formed as 9/16 inch diameter holes. The second member 30 preferably has a 4.50 inch outside diameter schedule 40 galvanized pipe approximately 50 inches in length with a 4 1/16 inch cap plate 38 securely fixed to the second end 20, such as by welding or the like. The first member preferably is formed as a 4 inch outside diameter, 3½ inch inside diameter schedule 40 galvanized pipe of approximately 48 inches in length with a cold formed flange 40 having a 4.50 inch outer diameter at one end defining the first end 18 of the load bearing member 16. The opposite end 42 of the first member 28 is slidably engaged within the second member 30. A plurality of longitudinally spaced first apertures 32 are formed through diametrically opposed side walls of the first member 28 at one inch on center intervals over a substantial longitudinal length of the first member 28. By way of example, and not limitation, the first apertures 32 may begin 12 inches from the end opposite the first end 18 of the load bearing member 16 extending along 26 inches of the overall 48 inch length of the first member 18. This configuration allows adjustment of the telescopic length of the load bearing member 16 to within ⅛ inch of the desired final position by longitudinally sliding the first member 28 within the second member 30 and by adjusting the first member 28 rotatably with respect to the second member 30 so that the appropriate first aperture 32 aligns coaxially with the desired second aperture 34 allowing placement of fastener means 44 through the coaxially aligned first and second apertures 32 and 34 respectively.

The fastener means 44 is provided for locking the first and second members, 28 and 30 respectively, in a fixed position relative to one another at a selected position of telescopic extension to level the structure 12 with respect to the ground 14 in the final position when engaged through the aligned first and second apertures, 32 and 34 respectively. The first and second members, 28 and 30 respectively, including the first and second apertures, 32 and 34 respectively, in combination with the fastener means 44 define position adjusting means for holding the structure 12 in the final position relative to ground 14 after in situ assembly. The fastener means 44 may include a bolt 46 and nut 48, 10 or the like engageable through the aligned first and second apertures, 32 and 34 respectively.

Figure 3:
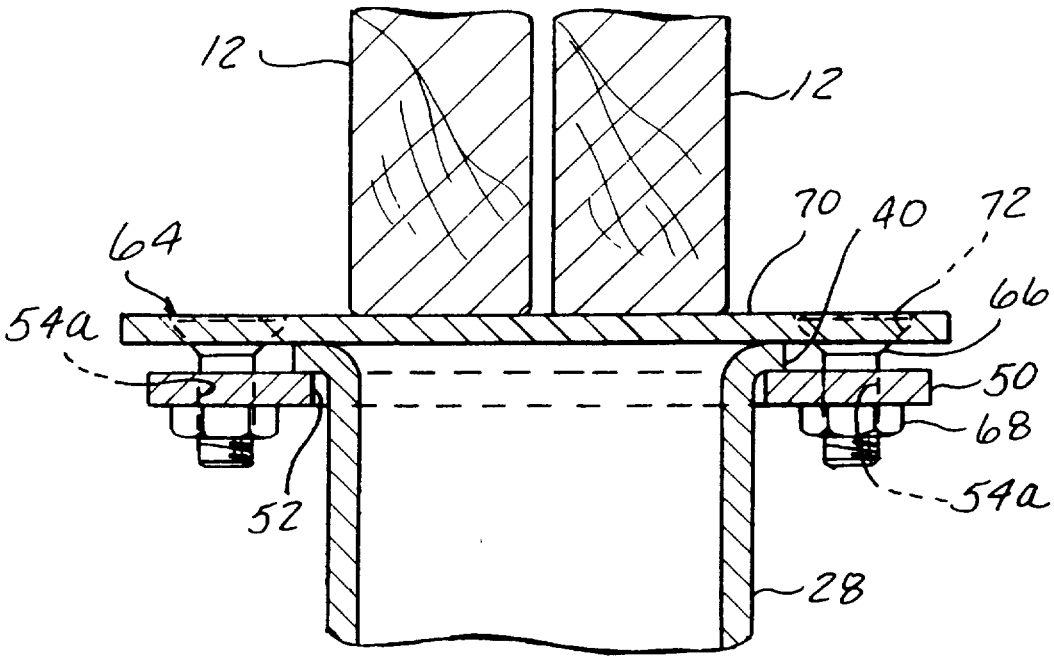
FIG. 3 is a detailed view of a second embodiment of a connection between the first end of an elongated, vertically extending, load bearing member and a structural beam on the underside of the structure to be erected on site.

The connecting means 22 connects the first end 18 of the load bearing member 16 to the structure 12 to be erected on site. The connecting means 22 may include the load bearing member having a radially outwardly extending lip or flange 40 at the first end 18, and a plate 50 having an aperture 52 formed therethrough for slidably receiving the load bearing member 16, such as first member 28, so that the flange 40 is interposed between the plate 50 and the structure 12 to be erected on site. The plate 50 preferably includes a plurality of elongated slots 54 formed therein. Preferably, the plurality of elongated slots 54 extend along opposite sides 56 and 58 of the plate 50. A plurality of structure-engaging clips or flat clamps 60 are disposed with apertures 62 formed therethrough in alignment with slots 54. Means 64 for fastening the clamps 60 to the plate 50 through the apertures 62 and slots 54 is provided, such that the structure 12 is held stationary and interposed between the clamps 60 and the plate 50. The fastening means 64 may include bolts 66 and nuts 68 or the like. As illustrated in FIG. 3, the clamps 60 may be replaced with a flat plate 70 when supporting the central structure 12, such as wooden beams, of a double wide manufactured housing, or modular housing, configuration. The flat plate 70 can include a plurality of apertures 72 formed therein alignable with the apertures **54*a* in the plate 50 for engagement therethrough by fastener means 64, such as bolts 66 and nuts 68** or the like.

Figure 7:
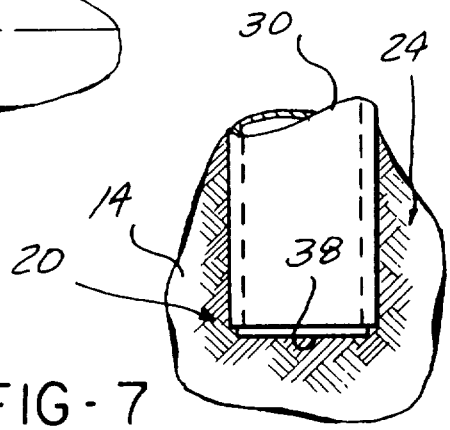
FIG. 7 is a third configuration of means for engaging the second end of the vertically load bearing member extending with respect to the ground.
Figure 2:
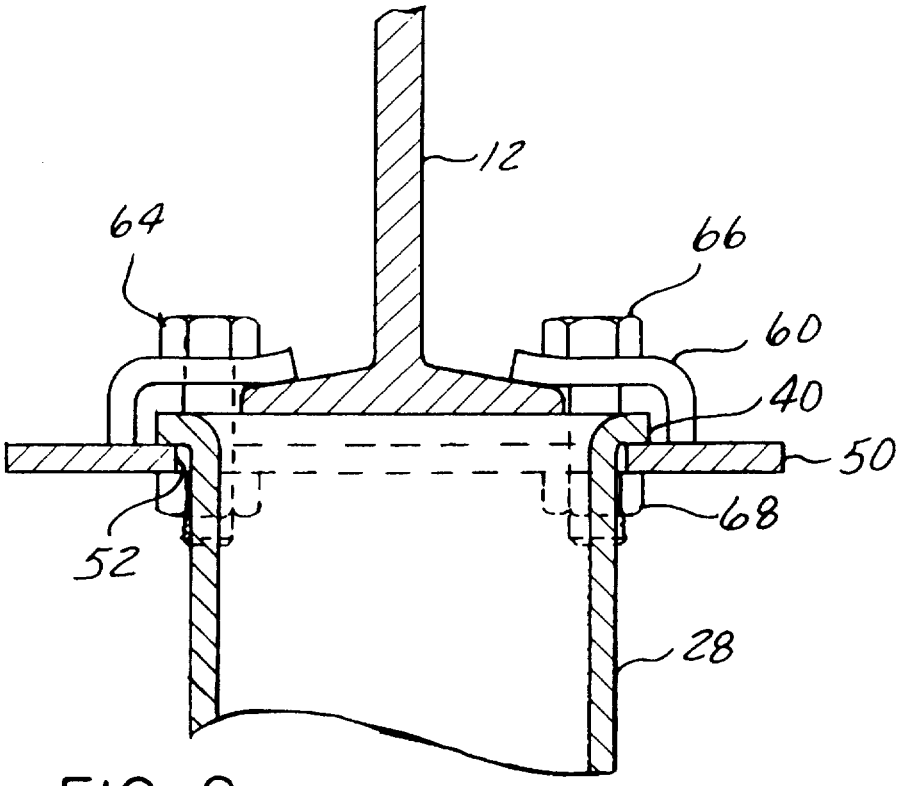
FIG. 2 is a detail of a first embodiment of a connection between a first end of an elongated, vertically extending, load bearing member and a structural beam supporting the underside of the structure to be erected on site.
Figure 5:
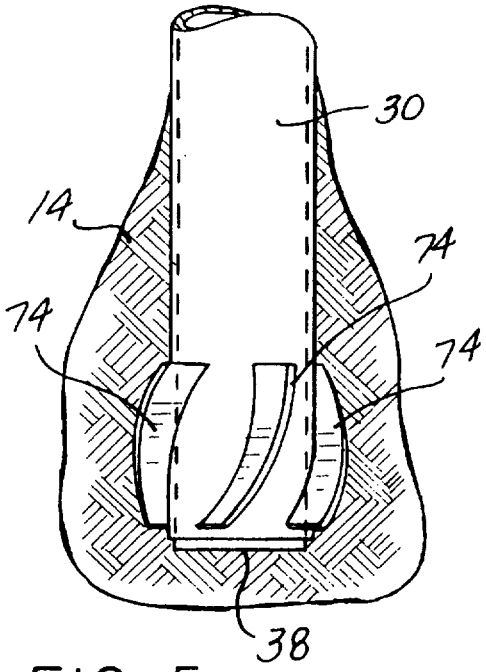
FIG. 5 is a first configuration of means for engaging the second end of the vertically extending load bearing member with respect to the ground.
Figure 6:
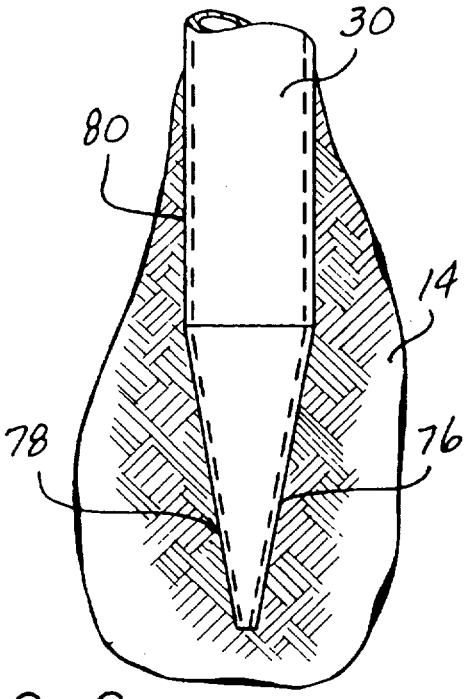
FIG. 6 is a second configuration of means for engaging the second end of the vertically extending load bearing member with respect to the ground.

Means 24 is provided for engaging the second end 20 of the load bearing member 16 with respect to or in the ground 14 as best seen in FIGS. 5–7. The simplest configuration is illustrated in FIG. 7, where the second member 30 defines the second end 20 of the load bearing member 16. The second end 20 is closed by flat plate 38 to prevent entry of earth therein. The flat plate 38 may be formed by the slug removed from the plate 50 when forming the aperture 52 therethrough. The closed second end 20 of the load bearing member 16 allows for installation of the load bearing member 16 into the ground 14 by any suitable means for impacting on the opposite end 36 of the second member 30 opposite from the closed second end 20. As illustrated in FIG. 5, the second end 20 may also include at least one radially extending, helical blade 74 disposed on an external surface of the load bearing member 16 adjacent to the second end 20. The radially extending, helical blades 74 causing the load bearing member 16 to spiral as it is driven into the ground 14 and increasing the surface area of the load bearing member 16 below ground 14 thereby improving the load bearing capacity and uplift resistance. As illustrated in FIG. 6, the second end 20 of the load bearing member 16 may be formed with a closed end having a reduced outer dimension as illustrated at 76. In this configuration, the second end 20 of the load bearing member 16 tapers from a smallest outer dimension 78 adjacent the second end 20 to a uniform consistent outer diameter or dimension 80 of the load bearing member 16. The uniform consistent outer diameter 80 extends along at least a substantial portion, or approximately ½ of the load bearing member 16, or along at least a substantial portion of second member 30 of the load bearing member 16. The uniformly, smooth tapering surface 76 of the second end 20 of the load bearing member may define a pencil-like shape, and may be formed integrally on the second end 20 of the load bearing member 16, or may be attached on the end of the uniform outer diameter 80 of the load bearing member 16.

The helical blades 74 improve the load bearing capacity and uplift resistance of the load bearing member 16. When the lower tube is driven into the ground, it spirals or twists. When the top plate 50 is secured to the structure 12 and the fastener means 44 is installed through the aligned apertures in the first and second members, 28 and 30 respectively, the load bearing member 16 is prevented from further rotation. This causes the blades 74 to act as a barb or mushroom anchor preventing dislocating movement of the load bearing member 16 with respect to the ground 14. The helical blades 74 may extend up to approximately ½ the length of the second member 30 with a helix angle measured with respect to vertical in a range of between approximately 10° to 30°, with a preferred angle of approximately 15°. There may be a single helical blade 74, or a plurality of helical blades 74 depending on the soil conditions and the degree of resistance to movement of the load bearing desired, or required under the prevailing building codes.

In use, the location of the piers for the foundation are laid out on the lot site with relation to the particular structure to be installed. All of the second members 30 are driven into the ground 14 to a depth of 44 inches or to local code specifications. The first member 28 is slidably installed through the aperture 52 in the plate 50 and then slidably installed into the second member 30. Using a transit or water level, the top of each first member 28 is measured and adjusted by sliding the first member 32 with respect to the second member 30 to create a level plane on which the structure will rest. When each first member 28 is appropriately measured and adjusted to level, a mark is made at the top edge 36 of the second member 30 on the first member 28 to be used later. The first member 28 is returned to a lowered position. The structure is then delivered onto the site and disposed above the pier foundation. The structure is held at an elevated position allowing each first member 28 to be raised to its leveled position. Appropriate fastener means 44, such as bolts 46 and nuts 48 are installed through the aligned first and second apertures, 32 and 34 respectively, by rotating the first member 28 until the appropriate apertures are coaxial with one another. The longitudinal and rotational movement of the first and second members with respect to one another allow positioning of the top of the first member 32 within ⅛ of an inch of the level plane. The structure is then lowered until it touches the top of the load bearing member 16. The weight of the structure is not allowed to sit on the load bearing members 16 until the plates 50 have been secured to the structure 12. In order to secure the plate 50 to the structure 12, plate 50 is raised into position and secured to the structure 12 by the appropriate clips or clamps 60 depending on the configuration encountered. Appropriate means for fastening 64 is provided to secure the structure 12 to the load bearing member 16. The structure is then lowered to rest entirely on the load bearing members 16.

Figure 8:
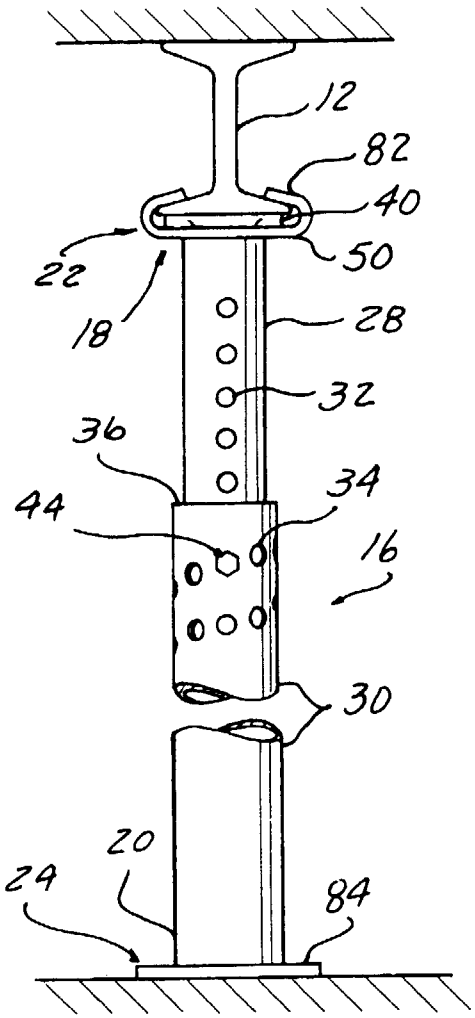
FIG. 8 is an alternative configuration of the present invention for use as a load support from a stable lower surface, such as a basement pillar support.

As illustrated in FIG. 8, the present invention may be modified to provide an elongated, vertically extendable, load bearing member 16, such as a vertically adjustable basement pillar support. As previously described, the load bearing member 16 includes first and second telescopically engaged members 28 and 30 respectively. The first member 28 having a plurality of longitudinally spaced first apertures 32 and a radially outwardly extending flange 40 adjacent a first end 18. The second member 30 includes a plurality of longitudinally spaced and circumferentially spaced second apertures 34 opposite from a second end 20. Means 24 is provided on the second end 20 of the load bearing member 16 for engagement with respect to the ground 14 or other supporting surface, such as a lower floor. The connecting means 22 may include bent over tabs 82 engaging with the structure 12, such as a I-beam supporting the upper floor. The engaging means 24 may include an enlarged plate 84 for supporting the second member 30 with respect to the supporting surface. When adjusted for the appropriate dimension by longitudinally extending the first member 28 with respect to the second member 30, the first member 28 is rotatably adjustable with respect to the second member 30 to align the appropriate first aperture with a corresponding second aperture in coaxial relationship with one another for engagement with the fastener means 44 to lock and hold the first member 28 with respect to the second member 30 against further longitudinal and rotational displacement with respect to one another.

Figure 9:
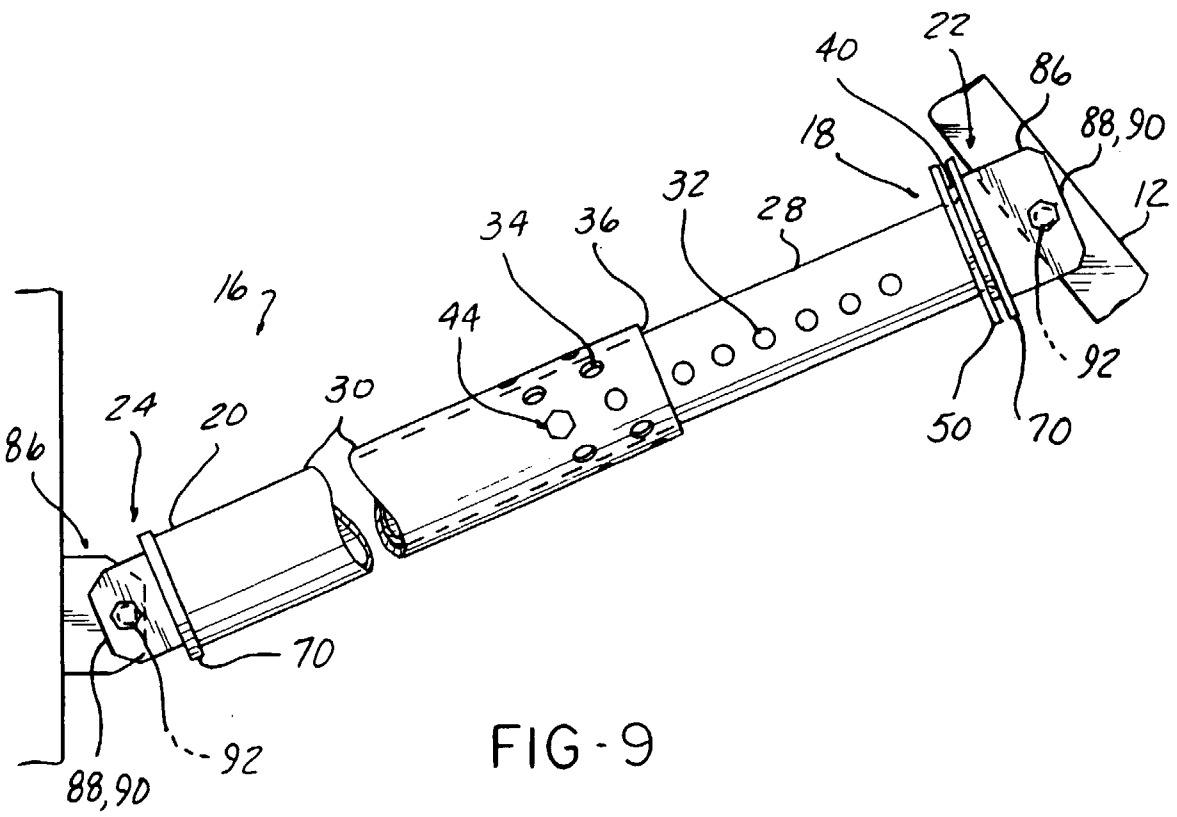
FIG. 9 is an alternative configuration of the present invention for use as an adjustable stanchion for supporting a movable element at an adjustable distance from a stable surface, such as a collapsible awning support.

It is further anticipated that the present invention can be modified as illustrated in FIG. 9 to provide an elongated, adjustable load bearing member 16 such as an adjustable stanchion for an awning. As previously described, the load bearing member 16 preferably includes first and second telescopically engaged members, 28 and 30 respectively. The first member 28 has a plurality of longitudinally spaced first apertures 32. The second member 30 has a plurality of longitudinally spaced and circumferentially spaced second apertures 34. Means 44 is provided for fastening the first and second members, 28 and 30, in a fixed position longitudinally and rotatably with respect to one another. Means 22 is provided at a first end 18 of the load bearing member 16 for connecting to structure 12, such as an awning. The connecting means in this configuration may include a generally U-shaped adapter 86 for engaging the structure 12. The adapter 86 may include first and second plate-like members, 88 and 90 respectively, extending parallel with one another. The first and second plate-like members, 88 and 90, each having an aperture 92 formed therein along a common axis perpendicular to the longitudinal axis of the load bearing member 16. The first and second plate-like members 88 and 90 are connected to a flat plate 70 for attachment to the plate 50 by suitable fastening means 64 (as shown in FIG. 3). The radially outwardly extending flange 40 formed on the first end 18 of the load bearing member 16 is interposed between the plate 50 and the flat plate 70. Means 24 is provided on the second end 20 of the load bearing member 16 for engaging with a support surface, such as a vertically extending wall of a building or the like. In this configuration, the engaging means 24 may include a U-shaped adapter 86 connected to the second end 20 of the second member 30 of the load bearing member 16. The U-shaped adapter 86 include first and second plate-like members 88 and 90. Each plate-like member 88 and 90 has an aperture 92 formed therethrough along a common axis perpendicular to the longitudinal axis of the load bearing member 16, as previously described for the opposite end of the load bearing member.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A pier foundation system for supporting at least one structure to be erected on site at a final position level relative to ground comprising:

an elongated, vertically extendable, load bearing member having a first end and a second end;

means for connecting said first end to said structure to be erected on site, wherein said means for connecting includes said load bearing member having a radially outwardly extending lip at one end thereof and a plate having an aperture formed therethrough for slidably receiving said load bearing member, such that said lip is interposed between said plate and said structure to be erected on site;

means for engaging said second end in said ground; and position adjusting means for holding said structure in said final position relative to ground after in situ assembly.

2. The pier foundation system of claim 1 wherein said means for connecting further comprises:

said plate having a plurality of elongated slots formed therein;

a plurality of structure-engaging clamps disposed with apertures in alignment with said slots; and means for fastening said clamps to said plate through said apertures and slots such that said structure is held stationary interposed between said clamps and said plate.

3. The pier foundation system of claim 1 wherein said load bearing member further comprises:

first and second telescopically engaged members slidable longitudinally with respect to one another, said first member defining said first end of said load bearing member and said second member defining said second end of said load bearing member.

4. The pier foundation system of claim 3 wherein said load bearing member further comprises:

said first and second members having cylindrical external surfaces and at least one of said members having an internal cylindrical surface defining a hollow longitudinally extending aperture for slidably receiving the other of said first and second members telescopically.

5. The pier foundation system of claim 1 wherein said means for engaging further comprises:

said second end of said load bearing member being closed to prevent entry of earth therein.

6. The pier foundation system of claim 5 wherein said means for engaging further comprises:

said load bearing member having an impact-receiving portion intermediate said first and second ends for installation of said load bearing member into the ground.

7. The pier foundation system of claim 5 wherein said means for engaging further comprises:

a flat plate connected to the second end of the load bearing member.

8. The pier foundation system of claim 7 wherein said means for engaging further comprises:

said second end having at least one radially extending, helical blade disposed on an external surface of said load bearing member adjacent said second end to spiral the load bearing member when driven into the ground thereby improving load bearing capacity and uplift resistance.

9. The pier foundation system of claim 5 wherein said means for engaging further comprises:

said second end of said load bearing member formed with a closed end having a reduced outer dimension.

10. The pier foundation system of claim 9 wherein said means for engaging further comprises:

said second end of said load bearing member tapering from a smallest outer dimension adjacent said second end to a uniform, consistent outer dimension of said load bearing member.

11. A pier foundation system for supporting at least one structure to be erected on site at a final position level relative to ground comprising:

an elongated, vertically extendable, load bearing member having a first end and a second end;

means for connecting said first end to said structure to be erected on site;

means for engaging said second end in said ground; and position adjusting means for holding said structure in said final position relative to ground after in situ assembly, wherein said position adjusting means for holding includes said load bearing member having first and second telescopically engaged members, said first member having a plurality of longitudinally spaced first apertures disposed at a predetermined interval from one another, said second member having a plurality of helically spaced second apertures disposed at a predetermined longitudinal and angular dimension from one another, such that one of said first and second members is moveable longitudinally and rotationally with respect to the other of said first and second members to align at least one of said first and second apertures coaxially with respect to one another allowing fine adjustment of a telescopic length of said load bearing member, and fastener means for engaging through said aligned coaxial first and second aperture for locking said first and second members against further longitudinal and rotational movement in relation with one another.

12. A pier foundation system for a preformed building structure to be erected on site in a final position level to ground comprising:

first and second elongated cylindrical members telescopically engaged with one another defining a longitudinally extendible load bearing member with first and second ends, said second cylindrical member installable extending below ground level;

first means formed on one of said first and second members for defining a plurality of longitudinally spaced first apertures extending through diametrically opposed side walls of said cylindrical member;

second means formed on the other of said first and second members for defining a plurality of angularly spaced and longitudinally spaced second apertures extending through diametrically opposed side walls of said cylindrical member, said first and second members moveable longitudinally and rotatably relative to one another to bring one of said first apertures into alignment with one of said second apertures; and means engageable through said aligned first and second apertures for locking said first and second members in a fixed position relative to one another at a selected position of telescopic extension to level said structure with respect to said ground in said final position.

13. The pier foundation system of claim 12 further comprising:

means for connecting said first end of said load bearing member to said structure to be erected on site.

14. A pier foundation system for a preformed building structure to be erected on site in a final position level to ground comprising:

first and second elongated cylindrical members telescopically engaged with one another defining a longitudinally extendible load bearing member with first and second ends, said second cylindrical member installable extending below ground level;

first means formed on one of said first and second members for defining a plurality of longitudinally spaced first apertures extending through diametrically opposed side walls of said cylindrical member;

second means formed on the other of said first and second members for defining a plurality of angularly spaced and longitudinally spaced second apertures extending through diametrically opposed side walls of said cylindrical member, said first and second members moveable longitudinally and rotatably relative to one another to bring one of said first apertures into alignment with one of said second apertures;

means engageable through said aligned first and second apertures for locking said first and second members in a fixed position relative to one another at a selected position of telescopic extension to level said structure with respect to said ground in said final position; and means for connecting said first end of said load bearing member to said structure to be erected on site, wherein said means for connecting includes said first cylindrical member having a radially outwardly extending lip at one end thereof, a plate having an aperture formed therethrough for slidably receiving one end of said first cylindrical member, such that said lip is interposed between said plate and said structure to be erected on site, said plate having a plurality of elongated slots formed therein extending along opposite sides of said plate, a plurality of structure-engaging clamps disposed with apertures in alignment with said slots, and means for fastening said clamps to said plate through said apertures and slots such that said structure is held stationary interposed between said clamps and said plate.

15. The pier foundation system of claim 12 further comprising:

means for engaging said second end of said load bearing member in said ground.

16. The pier foundation system of claim 15 wherein said means for engaging further comprises:

said second end disposed on said second cylindrical member and having a plate connected thereto closing the second end to prevent entry of earth therein, said closed second end for allowing installation of said load bearing member into the ground by impact on a portion of said second cylindrical member opposite from said closed second end.

17. The pier foundation system of claim 16 wherein said means for engaging further comprises:

said second end having at least one radially extending, helical blade disposed on an external surface of said second cylindrical member adjacent said second end to spiral the second cylindrical member when driven into the ground thereby improving load bearing capacity and uplift resistance.

18. The pier foundation system of claim 15 wherein said means for engaging further comprises:

said second end disposed on said second cylindrical member of said load bearing member and formed with a closed end having a reduced outer dimension, said second end of said second cylindrical member tapering from a smallest outer dimension adjacent said second end to a uniform, consistent outer dimension of said second cylindrical member.

19. A pier foundation system for a preformed building structure to be erected on site in a final position level to ground comprising:

first and second elongated cylindrical members telescopically engaged with one another defining a longitudinally extendible load bearing member with first and second ends, said second cylindrical member having a substantial portion installable extending below ground level, said first cylindrical member having a plurality of longitudinally spaced first apertures extending through diametrically opposed side walls of said first cylindrical member, said second cylindrical member having a plurality of helically spaced second apertures extending through diametrically opposed side walls of said second cylindrical member extending above ground level, said first and second members moveable longitudinally and rotatably relative to one another to bring one of said first apertures into alignment with one of said second apertures;

means engageable through said aligned first and second apertures for locking said first and second members in a fixed position relative to one another at a selected position of telescopic extension to level said structure with respect to said ground in said final position;

means for connecting said first end of said load bearing member to said structure to be erected on site; and means for engaging said second end of said load bearing member in said ground.

20. A system for supporting at least one structure in a position relative to a support surface in situ comprising:

an elongated, extendable, load bearing member having a first end and a second end;

means for connecting said first end to said at least one structure in situ, wherein said means for connecting includes said load bearing member having a radially outwardly extending lip at one end thereof and a plate having an aperture formed therethrough for slidably receiving said load bearing member, such that said lip is interposed between said plate and said structure;

means for engaging said second end with respect to said support surface; and position adjusting means for holding said structure in said position relative to said support surface after in situ assembly.

21. The system of claim 20 wherein said position adjusting means for holding further comprises:

said load bearing member having first and second telescopically engaged members, said first member having a plurality of longitudinally spaced first apertures disposed at a predetermined interval from one another, said second member having a plurality of helically spaced second apertures disposed at a predetermined longitudinal and angular dimension from one another, such that one of said first and second members is moveable longitudinally and rotationally with respect to the other of said first and second members to align at least one of said first and second apertures coaxially with respect to one another allowing fine adjustment of a telescopic length of said load bearing member; and fastener means for engaging through said aligned coaxial first and second aperture for locking said first and second members against further longitudinal and rotational movement in relation with one another.

22. The system of claim 20 wherein said system comprises a pier foundation system for supporting said at least one structure to be erected on site in said position and generally level relative to said support surface in situ, wherein said support surface is ground.

23. A system for supporting at least one structure in a position relative to a support surface in situ comprising:

first and second elongated cylindrical members telescopically engaged with one another defining a longitudinally extendible load bearing member with first and second ends, said second cylindrical member installable with respect to said support surface;

first means formed on one of said first and second members for defining a plurality of longitudinally spaced first apertures extending through diametrically opposed side walls of said cylindrical member;

second means formed on the other of said first and second members for defining a plurality of angularly spaced and longitudinally spaced second apertures extending through diametrically opposed side walls of said cylindrical member, said first and second members moveable longitudinally and rotatably relative to one another to bring one of said first apertures into alignment with one of said second apertures; and means engageable through said aligned first and second apertures for locking said first and second members in a fixed position relative to one another at a selected position of telescopic extension to position said structure with respect to said support surface in said position.

24. The system of claim 23 further comprising:

means for connecting said first end of said load bearing member to said structure in situ, wherein said means for connecting includes said first cylindrical member having a radially outwardly extending lip at one end thereof, a plate having an aperture formed therethrough for slidably receiving one end of said first cylindrical member, such that said lip is interposed between said plate and said structure, said plate having a plurality of elongated slots formed therein extending along opposite sides of said plate, a plurality of structure-engaging clamps disposed with apertures in alignment with said slots, and means for fastening said clamps to said plate through said apertures and slots such that said structure is held stationary interposed between said clamps and said plate.

25. The system of claim 23 wherein said system comprises a pier foundation system for supporting said at least one structure to be erected on site in said position and generally level relative to said support surface in situ, wherein said support surface is ground.

* * * * *